United States Patent [19]

Gutner

[11] 3,981,553

[45] Sept. 21, 1976

[54] DRAWER SLIDE

[76] Inventor: Kenneth H. Gutner, 3285 Dato, Highland Park, Ill. 60035

[22] Filed: Dec. 5, 1975

[21] Appl. No.: 638,067

[52] U.S. Cl. ..... 312/347; 308/3.6; 312/344; 312/342

[51] Int. Cl.[2] ..... A47B 88/00; A47F 5/08

[58] Field of Search ..... 308/3.8, 3.6; 312/330, 312/341–347

[56] References Cited

UNITED STATES PATENTS

| | | | |
|---|---|---|---|
| 3,328,107 | 6/1967 | Gutner | 312/347 |
| 3,363,960 | 1/1968 | Reiss et al. | 312/347 |
| 3,365,261 | 1/1968 | Gutner | 312/347 |
| 3,804,484 | 4/1974 | West et al. | 312/347 |

*Primary Examiner*—Casmir A. Nunberg

*Attorney, Agent, or Firm*—Dawson, Tilton, Fallon & Lungmus

[57] ABSTRACT

A member having a C-shaped cross section installable on the underside of a drawer to coact with an elongated dresser guide having a generally T-shaped cross section, the slide member having elongated inwardly directed ribs in the vertical walls of the slide member, the ribs extending substantially over the length of the slide member and with additional inwardly directed ribs adjacent the front end of the slide member.

2 Claims, 6 Drawing Figures

DRAWER SLIDE

BACKGROUND AND SUMMARY OF INVENTION

This invention relates to a drawer slide and more particularly, a member having a C-shaped cross section installable on the underside of a drawer to coact with an elongated dresser guide having a generally T-shaped cross section. The instant invention constitutes an improvement over my prior U.S. Pat. No. 3,328,107.

In my prior patent, an elongated metal member having a general C-shape in cross section was disclosed. This slide member was well received by the trade, particularly among those manufacturers who did not care to go to the expensive and complicated installation of ball bearing guides. The patented slide member was readily installable and relatively rugged. However, because of its length and shape, it resulted, in some instances, in drawer play, i.e., side to side movement. Attempts to minimize this by keeping closer tolerances on the slide member created disadvantageous "drag" where the slide member bore against the dresser guide, i.e., the generally T-shaped member normally made of wood. Further, as the tolerances were tightened, distortions of the generally C-shaped cross section resulted which caused further disadvantages in operation, particularly removal of the drawer from the dresser and reinstallation.

All of the foregoing disadvantages have been avoided by the instant invention which makes use of a rib in each of the vertical side walls of the C-shaped section and which ribs run substantially the entire length of the slide member. The inventive ribs create a precision bearing surface with the T-shaped wooden guide so as to minimize play while at the same time minimizing drag and further rigidify or stabilize the cross section against undesirable distortion.

DETAILED DESCRIPTION

The invention is described in conjunction with an illustrative embodiment in the accompanying drawing, in which.

Figure 1:
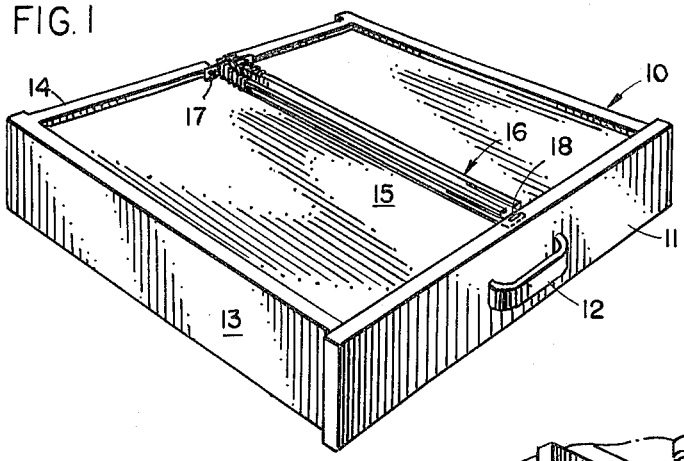
FIG. 1 is a perspective view of a drawer (open side down) and which shows the inventive slide member.
Figure 6:
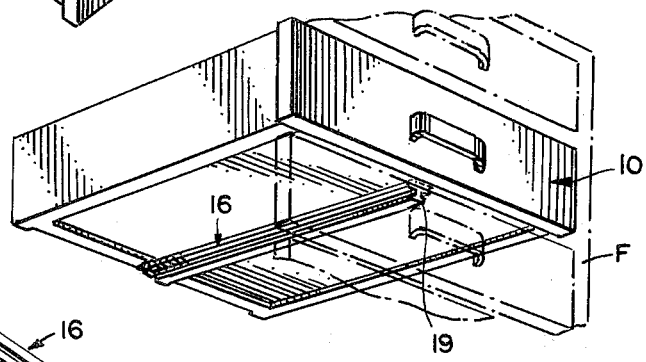
FIG. 6 is a fragmentary perspective view of a dresser or like structure which accommodates a plurality of drawers each utilizing the inventive slide.
Figure 2:
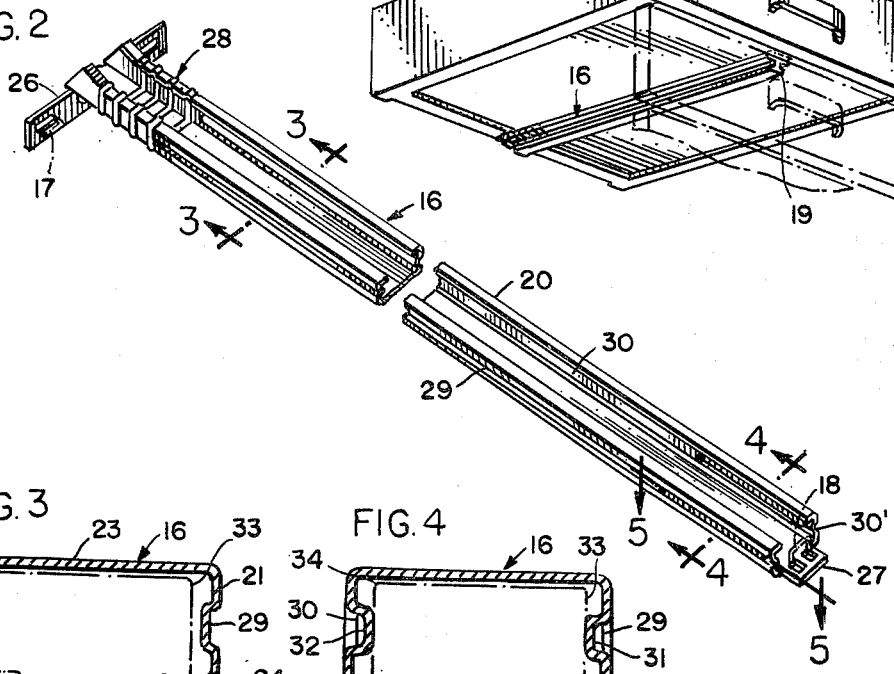
FIG. 2 is an enlarged perspective view, in fragmentary form, of the slide member of FIG. 1.

In the illustration given and with reference first to FIG. 1, the numeral 10 designates generally a drawer adapted to be mounted on the dresser or the like. The drawer may be of conventional form having a front panel 11 equipped with the usual handle or pull 12. Completing the drawer are side panels 13, a rear panel 14 and a bottom panel 15. The inventive slide member is designated generally by the numeral 16 and is secured by staples 17 (see also FIG. 2) to the rear panel 14. At its front end, the slide 16 is attached by an angled staple 18 both to the bottom panel 15 and the front panel 11.

The drawer 10 equipped with the slide 16 is seen installed in a dresser or like frame member F equipped with a generally T-shaped guide 19. The guide 19 is equipped with longitudinally extending slots in the sides thereof (see also FIGS. 3 and 4) which cooperate with the channel shaped or C-shaped section 20 of the slide 16. The C-shaped part 20 is defined by side walls 21 and 22 (see FIG. 3), a transverse wall 23 integral with the side walls 21 and 22, and confronting, inwardly extending integral flanges 24 and 25 provided, respectively, at the ends of the side walls 21 and 22.

The remainder of the slide includes a flared tab portion 26 at the rear end thereof (see FIG. 2) and a longitudinally extending tongue 27 at the extreme forward end. The slide 16 also includes rib means generally designated 28 (see the left hand portion of FIG. 2) which extends transversely of the slide 16 and are positioned at the end of the C-shaped section immediately adjacent the tab portion 26. A more detailed description of the rib means 28 can be seen in my prior U.S. Pat. No. 3,365,261. Reference also may be had to that patent for additional details of construction, dimensions and the like not set forth herein.

Figure 3:
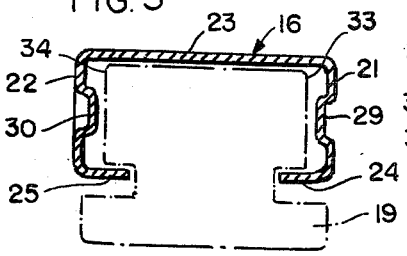
FIG. 3 is an enlarged transverse sectional view such as seen along the sight line 3—3 of FIG. 2 and which also shows (in phantom line) a cooperating guide normally provided as part of the dresser.
Figure 4:
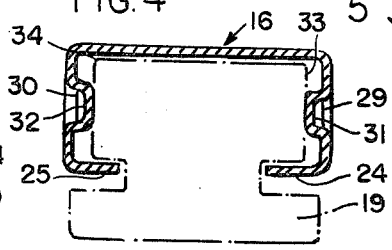
FIG. 4 is a view similar to FIG. 3 but taken along the line 4—4 of FIG. 2.

The instant invention is concerned with longitudinally extending ribs 29 and 30 provided in the vertically extending side walls 21 and 22, respectively (see FIG. 3). The ribs 29 and 30 extend substantially over the entire length of the C-shaped portion — except for that occupied by the rib means 28. For example, as can be appreciated from FIG. 2, the rib 30 extends to the very end of the C-shaped portion 20 as at 30' in the lower right hand portion of FIG. 2 — this being the end of the slide 16 adjacent the forward or outer end of the drawer 10.

Figure 5:
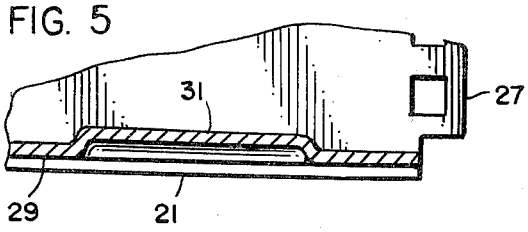
FIG. 5 is a longitudinal sectional view along the line 5—5 of FIG. 2.

In certain instances, I find it advantageous to retain the "drawer closer" feature of my earlier U.S. Pat. No. 3,328,107 in the form of additional ribs or indentations 31 and 32 essentially superposed or added to the ribs 29 and 30 (see FIGS. 4 and 5).

To further illustrate the illustrated embodiment of the invention, the slide 26 is advantageously constructed of 18 gauge to 24 gauge sheet steel. The length of the slide 16 is generally less than 24 inches, the conventional maximum drawer depth. The supplemental inwardly extending ribs 31 and 32 are advantageously confined within about the first 2-½ inches or so of length of the slide 16, measured from the forward or outer end. Even with a popular size drawer of 14 inches depth, the supplemental indentations or ribs 31 and 32 extend less than about 25% of the length of the slide 16.

The almost full length ribs 29 and 30 are inwardly extending depressions or indentations of the order of about 0.025 inches and as such develop a reverse channel action in the side walls 21 and 22 tending to maintain them in original configuration. The ribs 29 and 30 project inwardly toward the guide 19 — more particularly, toward the upper vertical side walls 33 and 34 of the guide 19 (see FIG. 3). In FIG. 3, an exaggerated clearance between the ribs 29 and 30 and the guide walls 33 and 34 is shown but it will be appreciated that in normal practice that one or the other or both of the longitudinally extending ribs 29 and 30 will slideably engage the walls 33 and 34, respectively. The engagement is restricted in area to the height of the ribs 29 and 30 so that the smooth sliding action is achieved without the undesirable drag characteristic of a certain prior art installations. Further, a snug "closure" is effective when the supplemental indentations 31 and 32 engage the walls 33 and 34 when the drawer is pushed completely "home" (see FIG. 4). When these supplemental indentations 31 and 32 are omitted closer clearances or tolerances are normally employed between the ribs 29 and 30 and the corresponding walls 33 and 34.

I claim:

1. A slidable drawer structure comprising a frame such as a dresser or the like having a generally rectangular drawer-receiving front opening, a drawer slidably received in said opening, said frame being equipped with an elongated side-sloted center guide for the underside of said drawer with said guide extending generally perpendicular to said opening, an elongated slide fixed to the underside of said drawer and slidably engaging said guide, said slide being generally C-shaped in transverse section to engage said guide slots, said C-shaped defining a horizontal top wall integrated with vertical side walls and inwardly extending flanges integrated with said side walls below said top walls, said slide adjacent the inserted end of said drawer being equipped with transversely extending rib means, a longitudinal rib in each vertical side wall extending from said rib means to the other end of said slide, said longitudinal ribs projecting inwardly of said C-shape and adapted to bear against said guide.

2. The construction of claim 1 in which said ribs are defomed inwardly adjacent said other end to grip said guide when said drawer is fully inserted, the deformed portion being less than 25% of the slide length.

* * * * *